US008820732B2

(12) United States Patent
Harano

(10) Patent No.: US 8,820,732 B2
(45) Date of Patent: Sep. 2, 2014

(54) IMAGE FORMING APPARATUS THAT USES SHEETS IN SETS, METHOD OF CONTROLLING THE SAME, AND STORAGE MEDIUM

(75) Inventor: Yuzo Harano, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/551,741

(22) Filed: Jul. 18, 2012

(65) Prior Publication Data

US 2013/0026697 A1 Jan. 31, 2013

(30) Foreign Application Priority Data

Jul. 27, 2011 (JP) ..... 2011-164432

(51) Int. Cl.
*B65H 3/44* (2006.01)
*G03G 15/00* (2006.01)

(52) U.S. Cl.
CPC .. *G03G 15/6594* (2013.01); *G03G 2215/00523* (2013.01)
USPC ..... 271/9.02; 271/9.01; 271/9.13

(58) Field of Classification Search
CPC ..... B65H 2701/11132
USPC ..... 271/9.03, 9.02, 9.13
See application file for complete search history.

(56) References Cited

U.S. PATENT DOCUMENTS

2006/0145414 A1* 7/2006 Yokobori et al. ..... 271/258.01
2008/0199200 A1* 8/2008 Nakagawa et al. ..... 399/81
2012/0261875 A1* 10/2012 Kaneda ..... 271/9.01

FOREIGN PATENT DOCUMENTS

JP 2002-003063 A 1/2002

* cited by examiner

*Primary Examiner* — Michael McCullough
*Assistant Examiner* — Howard Sanders
(74) *Attorney, Agent, or Firm* — Carter, DeLuca, Farrell & Schmidt, LLP

(57) ABSTRACT

An image forming apparatus which prevents lowering of productivity when sets of tab sheets are used in one print job. The apparatus includes first sheet feeding units storing tab sheets, and a second sheet feeding unit storing plain paper. The apparatus produces print products in each which at least part of each set of tab sheets and plain paper are mixed. A print job processor causes print products to be produced by repeating a sequence of processing for feeding the at least part of each set of tab sheets and feeding plain paper. The processor causes surplus tab sheets to be discharged which have not been used for the print products and remaining in the first sheet feeding units, after a print product is produced through sheet feeding from a last one of the first sheet feeding units in order.

6 Claims, 9 Drawing Sheets

FIG.4A

| SHEET FEEDING CASSETTE NUMBER | SHEET TYPE |
|---|---|
| 1 | TAB SHEET |
| 2 | TAB SHEET |
| 3 | TAB SHEET |
| 4 | PLAIN PAPER |
| 5 | THICK PAPER |

401
SHEET
INFORMATION

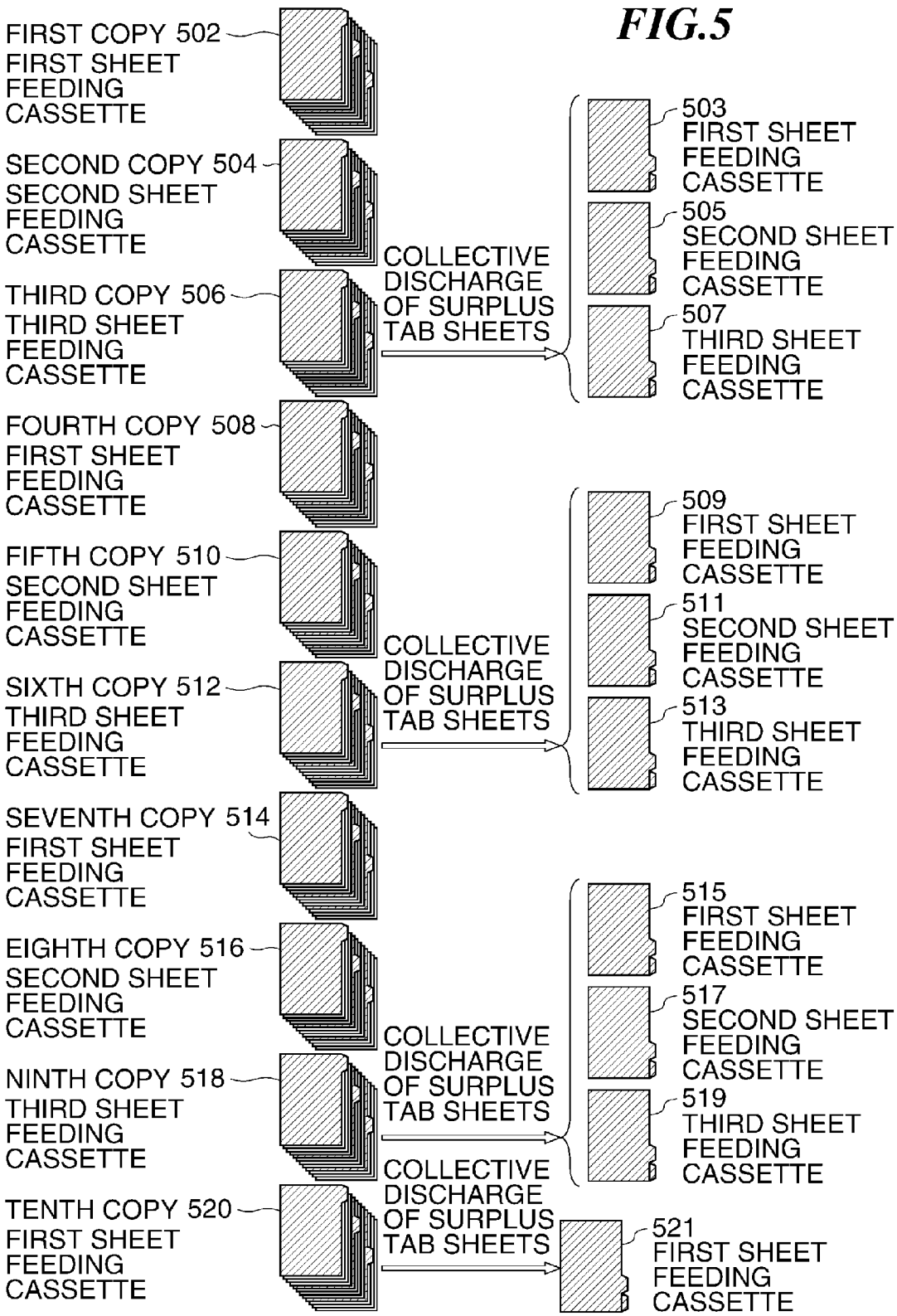
FIG.5
FIRST COPY 502
FIRST SHEET FEEDING CASSETTE
SECOND COPY 504
SECOND SHEET FEEDING CASSETTE
THIRD COPY 506
THIRD SHEET FEEDING CASSETTE
FOURTH COPY 508
FIRST SHEET FEEDING CASSETTE
FIFTH COPY 510
SECOND SHEET FEEDING CASSETTE
SIXTH COPY 512
THIRD SHEET FEEDING CASSETTE
SEVENTH COPY 514
FIRST SHEET FEEDING CASSETTE
EIGHTH COPY 516
SECOND SHEET FEEDING CASSETTE
NINTH COPY 518
THIRD SHEET FEEDING CASSETTE
TENTH COPY 520
FIRST SHEET FEEDING CASSETTE
COLLECTIVE DISCHARGE OF SURPLUS TAB SHEETS
COLLECTIVE DISCHARGE OF SURPLUS TAB SHEETS
COLLECTIVE DISCHARGE OF SURPLUS TAB SHEETS
COLLECTIVE DISCHARGE OF SURPLUS TAB SHEETS
503 FIRST SHEET FEEDING CASSETTE
505 SECOND SHEET FEEDING CASSETTE
507 THIRD SHEET FEEDING CASSETTE
509 FIRST SHEET FEEDING CASSETTE
511 SECOND SHEET FEEDING CASSETTE
513 THIRD SHEET FEEDING CASSETTE
515 FIRST SHEET FEEDING CASSETTE
517 SECOND SHEET FEEDING CASSETTE
519 THIRD SHEET FEEDING CASSETTE
521 FIRST SHEET FEEDING CASSETTE

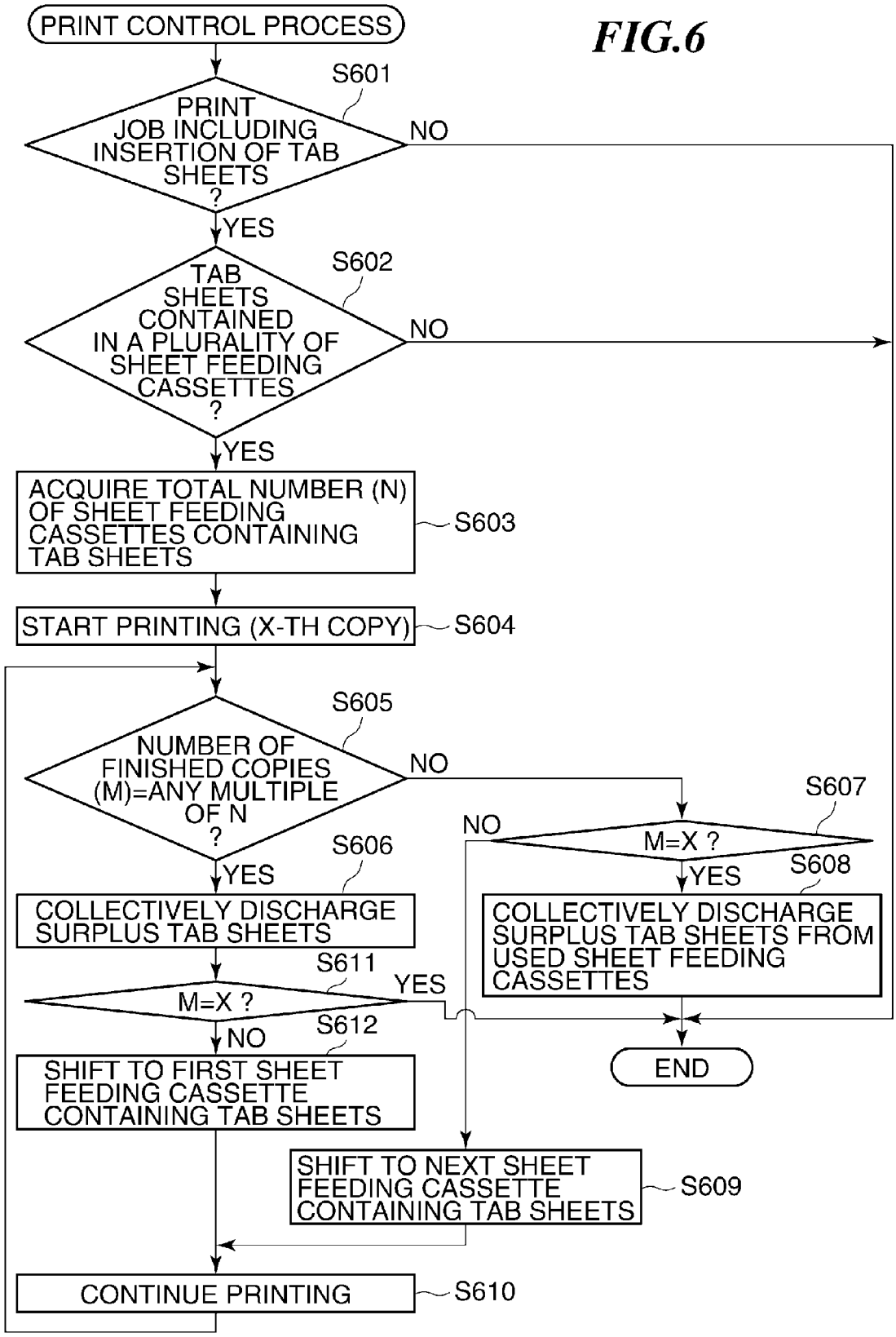
FIG.6
PRINT CONTROL PROCESS
S601
PRINT JOB INCLUDING INSERTION OF TAB SHEETS ?
NO
YES
S602
TAB SHEETS CONTAINED IN A PLURALITY OF SHEET FEEDING CASSETTES ?
NO
YES
ACQUIRE TOTAL NUMBER (N) OF SHEET FEEDING CASSETTES CONTAINING TAB SHEETS
S603
START PRINTING (X-TH COPY)
S604
S605
NUMBER OF FINISHED COPIES (M)=ANY MULTIPLE OF N ?
NO
YES
S606
COLLECTIVELY DISCHARGE SURPLUS TAB SHEETS
S607
M=X ?
NO
YES
S608
COLLECTIVELY DISCHARGE SURPLUS TAB SHEETS FROM USED SHEET FEEDING CASSETTES
S611
M=X ?
YES
NO
S612
SHIFT TO FIRST SHEET FEEDING CASSETTE CONTAINING TAB SHEETS
END
SHIFT TO NEXT SHEET FEEDING CASSETTE CONTAINING TAB SHEETS
S609
CONTINUE PRINTING
S610

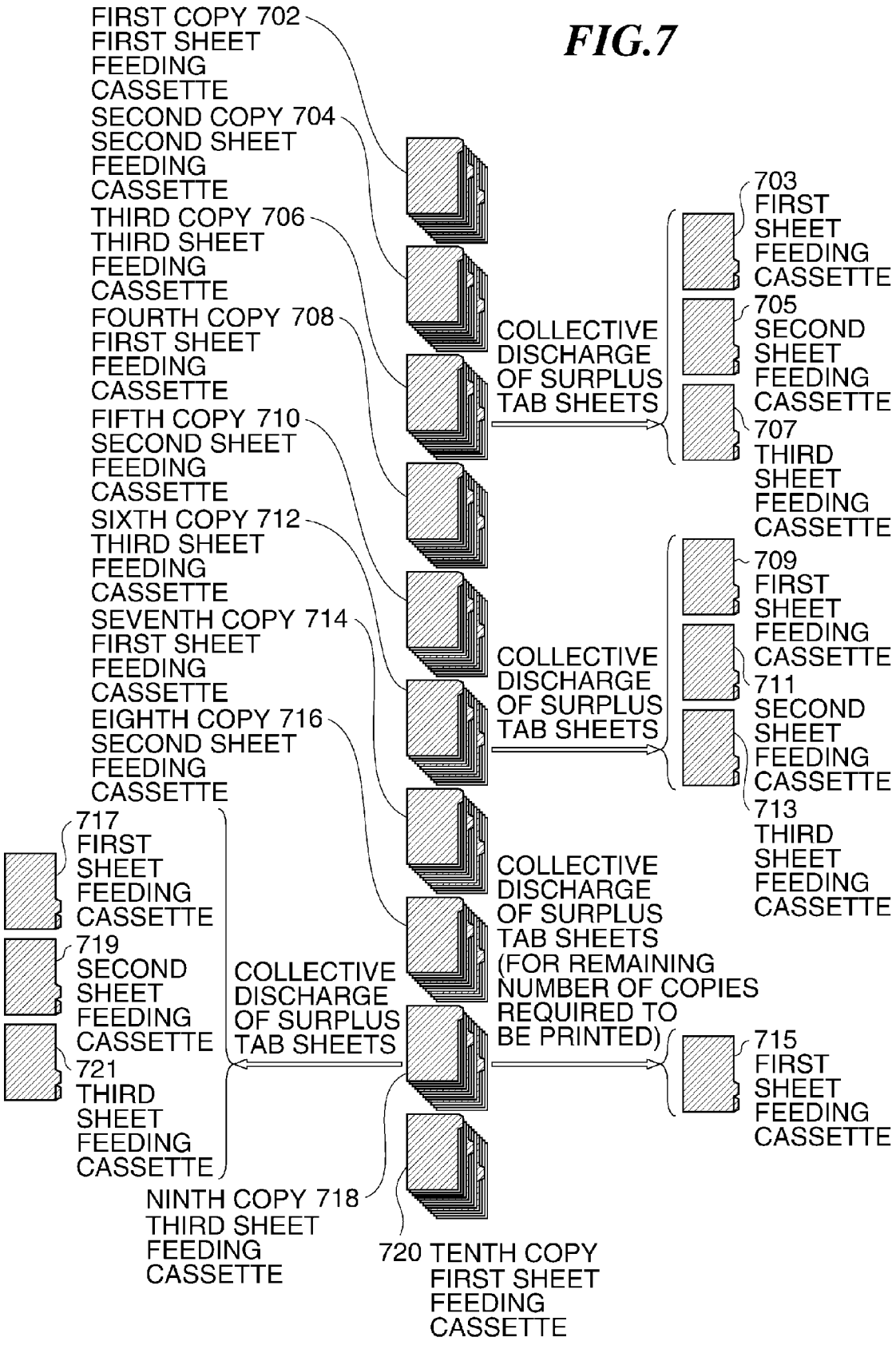
FIG.7
FIRST COPY 702 FIRST SHEET FEEDING CASSETTE
SECOND COPY 704 SECOND SHEET FEEDING CASSETTE
THIRD COPY 706 THIRD SHEET FEEDING CASSETTE
FOURTH COPY 708 FIRST SHEET FEEDING CASSETTE
FIFTH COPY 710 SECOND SHEET FEEDING CASSETTE
SIXTH COPY 712 THIRD SHEET FEEDING CASSETTE
SEVENTH COPY 714 FIRST SHEET FEEDING CASSETTE
EIGHTH COPY 716 SECOND SHEET FEEDING CASSETTE
717 FIRST SHEET FEEDING CASSETTE
719 SECOND SHEET FEEDING CASSETTE
721 THIRD SHEET FEEDING CASSETTE
COLLECTIVE DISCHARGE OF SURPLUS TAB SHEETS
NINTH COPY 718 THIRD SHEET FEEDING CASSETTE
720 TENTH COPY FIRST SHEET FEEDING CASSETTE
COLLECTIVE DISCHARGE OF SURPLUS TAB SHEETS
703 FIRST SHEET FEEDING CASSETTE
705 SECOND SHEET FEEDING CASSETTE
707 THIRD SHEET FEEDING CASSETTE
COLLECTIVE DISCHARGE OF SURPLUS TAB SHEETS
709 FIRST SHEET FEEDING CASSETTE
711 SECOND SHEET FEEDING CASSETTE
713 THIRD SHEET FEEDING CASSETTE
COLLECTIVE DISCHARGE OF SURPLUS TAB SHEETS (FOR REMAINING NUMBER OF COPIES REQUIRED TO BE PRINTED)
715 FIRST SHEET FEEDING CASSETTE

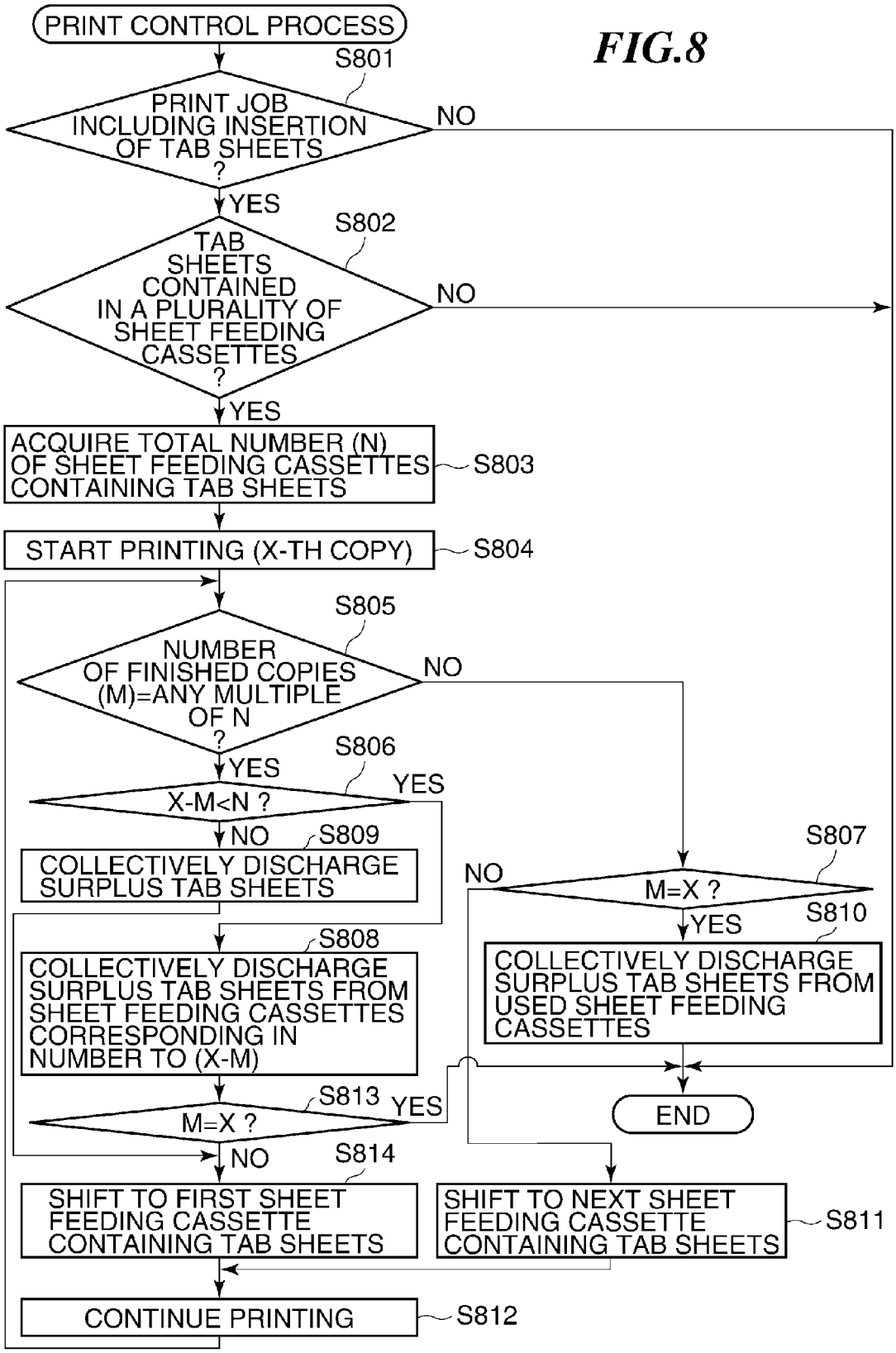
FIG.8
PRINT CONTROL PROCESS
S801
PRINT JOB INCLUDING INSERTION OF TAB SHEETS ?
NO
YES
S802
TAB SHEETS CONTAINED IN A PLURALITY OF SHEET FEEDING CASSETTES ?
NO
YES
ACQUIRE TOTAL NUMBER (N) OF SHEET FEEDING CASSETTES CONTAINING TAB SHEETS
S803
START PRINTING (X-TH COPY)
S804
S805
NUMBER OF FINISHED COPIES (M)=ANY MULTIPLE OF N ?
NO
YES
S806
X-M<N ?
YES
NO
S809
COLLECTIVELY DISCHARGE SURPLUS TAB SHEETS
S807
NO
M=X ?
YES
S810
COLLECTIVELY DISCHARGE SURPLUS TAB SHEETS FROM USED SHEET FEEDING CASSETTES
S808
COLLECTIVELY DISCHARGE SURPLUS TAB SHEETS FROM SHEET FEEDING CASSETTES CORRESPONDING IN NUMBER TO (X-M)
S813
M=X ?
YES
END
NO
S814
SHIFT TO FIRST SHEET FEEDING CASSETTE CONTAINING TAB SHEETS
SHIFT TO NEXT SHEET FEEDING CASSETTE CONTAINING TAB SHEETS
S811
CONTINUE PRINTING
S812

IMAGE FORMING APPARATUS THAT USES SHEETS IN SETS, METHOD OF CONTROLLING THE SAME, AND STORAGE MEDIUM

BACKGROUND OF THE INVENTION

1. Field of the Invention

The present invention relates to an image forming apparatus, a method of controlling the image forming apparatus, and a storage medium, and more particularly to an image forming apparatus that performs image formation capable of generating a print product in which a plurality of different sheets are mixed, a method of controlling the image forming apparatus, and a storage medium.

2. Description of the Related Art

Conventionally, in printing using tab sheets set in a sheet feeding cassette in an image forming apparatus, there has been known a technique for discharging surplus tab sheets outside the image forming apparatus after printing (see e.g. Japanese Patent Laid-Open Publication No. 2002-003063).

For example, one set of tab sheets is formed by a plurality of tab sheets. For example, one set of tab sheets including five tabs is formed by five sheets, and one set of tab sheets including three tabs is formed by three sheets. There has been generally used a technique in which assuming, for example, that three sheets out of a set of five tab sheets are used in one print job, two surplus tab sheets remain unused, and in such a case, the two surplus tab sheets are discharged out of the image forming apparatus after printing.

Although not limited to tab sheets, it is also general that when tab sheets are used again in the same or different job, sheet feeding is executed from the same sheet feeding cassette in which tab sheets are set.

However, if a plurality of sets of tab sheets are used in one print job, the productivity of the image forming apparatus is lowered.

For example, when a plurality of copies of a document are printed, surplus tab sheets in each copy are discharged out of the image forming apparatus, and tab sheets are continuously fed from the same sheet feeding cassette for all of the copies, and hence a ratio of time required to discharge surplus tab sheets to time required to obtain print products for the print job is large.

Next, a detailed description is given of a reason for such lowering of the productivity in generating print products due to discharge of surplus tab sheets.

In the above-mentioned conventional image forming apparatus, the temperature of a fixing device optimum for sheets is different depending on a sheet type, and hence whenever the sheet type is changed, the temperature of the fixing device is adjusted, and it takes time to achieve the temperature adjustment. After discharging the surplus tab sheets out of the apparatus as well, it requires time to adjust the temperature of the fixing device to a temperature optimum for normal sheets. However, particularly when the surplus tab sheets are discharged out of the apparatus, the fixing device does not perform a fixing operation, and hence the temperature of the fixing device is lowered, which requires a longer time period to achieve temperature adjustment of the fixing device for resuming printing. For these reasons, the productivity of generating printing products is lowered.

The above-mentioned temperature adjustment is executed whenever switching occurs between normal sheets and tab sheets in the print job. Therefore, it is desirable to minimize time required to discharge surplus tab sheets out of the apparatus, which is originally unnecessary for obtaining a print product for a print job.

As described above, in the conventional technique, in an image forming apparatus capable of generating print products printed by feeding different sheets from different sheet feeding cassettes, surplus sheets are discharged whenever one print product is generated. As a result, it takes time to perform temperature adjustment after the discharge of surplus sheets out of the apparatus whenever one print product in which different sheet types are mixed is generated.

SUMMARY OF THE INVENTION

The present invention provides an image forming apparatus which prevents productivity from being lowered when a plurality of sets of tab sheets are used in one print job.

In a first aspect of the present invention, there is provided an image forming apparatus including, among a plurality of sheet feeding cassettes in each of which printing sheets are set, a plurality of first sheet feeding units in which first sheets are set which are used in sets, each set being formed by a plurality of first sheets, and at least one second sheet feeding unit in which second sheets are set which are different from the first sheets, the image forming apparatus being capable of producing print products in each which at least part of each set of the first sheets and the second sheets are mixed, comprising a printing unit configured to produce a plurality of print products by repeating a sequence of processing for feeding the at least part of each set of the first sheets from each first sheet feeding unit and feeding the second sheets from the second sheet feeding unit to thereby produce each print product, and a sheet discharge unit configured to discharge surplus first sheets which have not been used for the print products and remaining in the plurality of first sheet feeding units, after one of the print products has been produced through sheet feeding from a last one of the plurality of first sheet feeding units, by the printing unit.

In a second aspect of the present invention, there is provided a method of controlling an image forming apparatus including, among a plurality of sheet feeding cassettes in each of which printing sheets are set, a plurality of first sheet feeding units in which first sheets are set which are used in sets, each set being formed by a plurality of first sheets, and at least one second sheet feeding unit in which second sheets are set which are different from the first sheets, the image forming apparatus being capable of producing print products in each which at least part of each set of the first sheets and the second sheets are mixed, the method comprising producing a plurality of print products by repeating a sequence of processing for feeding the at least part of each set of the first sheets from each first sheet feeding unit and feeding the second sheets from the second sheet feeding unit to thereby produce each print product, and discharging surplus first sheets which have not been used for the print products and remaining in the plurality of first sheet feeding units, after one of the print products has been produced through sheet feeding from a last one of the plurality of first sheet feeding units.

In a third aspect of the present invention, there is provided a non-transitory computer-readable storage medium storing a computer-executable program for causing a computer to execute a method of controlling an image forming apparatus including, among a plurality of sheet feeding cassettes in each of which printing sheets are set, a plurality of first sheet feeding units in which first sheets are set which are used in sets, each set being formed by a plurality of first sheets, and at least one second sheet feeding unit in which second sheets are set which are different from the first sheets, the image forming apparatus being capable of producing print products in each which at least part of each set of the first sheets and the second sheets are mixed, wherein the method comprises producing a plurality of print products by repeating a sequence of processing for feeding the at least part of each set of the first sheets from each first sheet feeding unit and feeding the second sheets from the second sheet feeding unit to thereby produce each print product, and discharging surplus first sheets which have not been used for the print products and remaining in the plurality of first sheet feeding units, after one of the print products has been produced through sheet feeding from a last one of the plurality of first sheet feeding units.

According to the present invention, when a plurality of sets of tab sheets are used in one print job, it is possible to prevent productivity in the image forming apparatus from being lowered.

Further features of the present invention will become apparent from the following description of exemplary embodiments with reference to the attached drawings.

BRIEF DESCRIPTION OF THE DRAWINGS

FIGS. 4A and 4B are views showing sheet information and a conventional sheet discharging method.

FIG. 5 is a view useful in explaining a method of feeding tab sheets and a method of discharging surplus tab sheets in the present embodiment.

FIG. 6 is a flowchart of a print control process executed by a CPU appearing in FIG. 1.

FIG. 7 is a view useful in explaining a method of feeding tab sheets and a method of discharging surplus tab sheets which are employed in a printing apparatus as an image forming apparatus according to a second embodiment of the present invention.

FIG. 8 is a flowchart of a print control process executed by the CPU in the second embodiment.

DESCRIPTION OF THE EMBODIMENTS

The present invention will now be described in detail below with reference to the accompanying drawings showing embodiments thereof.

Figure 1:
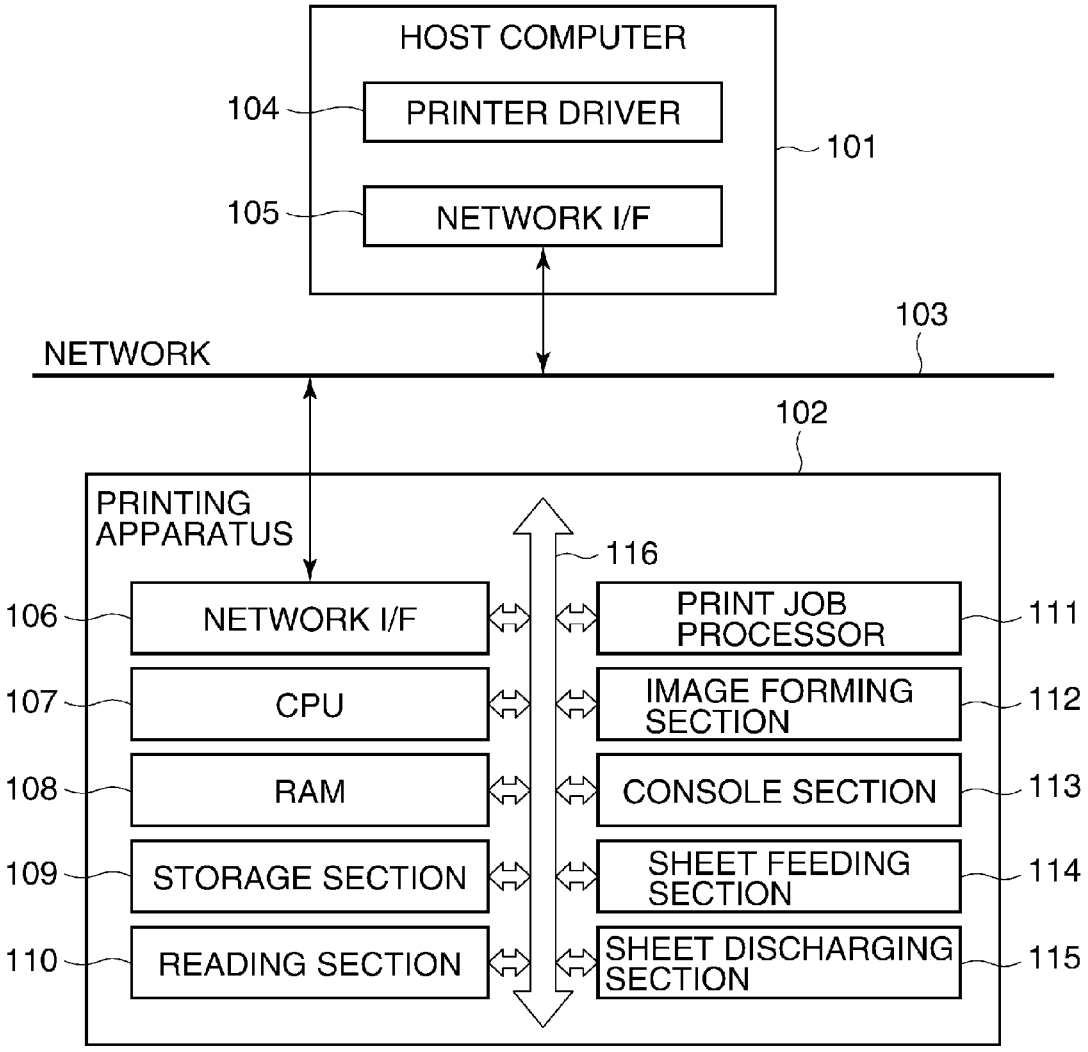
FIG. 1 is an explanatory view of the entire printing system including a printing apparatus as an image forming apparatus according to a first embodiment of the present invention.

FIG. 1 is an explanatory view of the entire printing system including a printing apparatus 102 as an image forming apparatus according to a first embodiment of the present invention.

Note that the printing system may be a stand-alone apparatus, or a system comprising a plurality of apparatuses, insofar as it executes functions of print processing and the like according to the present embodiment. Alternatively, the printing system may be a system which is connected via a network, such as a LAN (local area network) or a WAN (wide area network), to perform processing. That is, the system configuration to which various terminals are connected, described in the following embodiments, is only an example, and there are various examples of the configuration according to the uses and purpose.

First, the printing system comprises a host computer 101, the printing apparatus, denoted by reference numeral 102, and a network 103.

The host computer 101 is an apparatus having a printer driver 104 installed therein, and is connected to the network 103 via a network interface 105. In the present embodiment, the host computer 101 will be described as a PC (personal computer).

The printer driver 104 is software operating on an OS (operating system) which controls the host computer 101. Further, the printer driver 104 converts print data to PDL (page description language) data according to a print instruction from an application, and transmits the PDL data to the printing apparatus 102, as a print job.

The network interface 105 is used for connecting and communicating with external apparatuses via the network 103, and executes control processing for communication over the network. For example, the network interface 105 enables the Internet communication using TCP/IP (transmission control protocol/Internet protocol), and transmission and reception of data to and from the printing apparatus 102. The host computer 101 includes a CPU (central processing unit), a hard disk, a RAM (random access memory), and an input-output device, none of which are shown.

The printing apparatus 102 includes a network interface 106, a CPU 107, a RAM 108, a storage section 109, a reading section 110, a print job processor 111, an image forming section 112, a console section 113, a sheet feeding section 114, and a sheet discharging section 115. Further, these units are connected via a system bus 116. Note that in the present embodiment, the printing apparatus 102 is described as a MFP (multi-function peripheral) including functions of a copying machine, a printer, etc.

The network interface 106 is used for connecting and communicating with external apparatuses via the network 103, and executes control processing for communication over the network. For example, the network interface 106 enables the Internet communication using TCP/IP, and transmission and reception of data to and from the host computer 101.

The CPU 107 performs various numerical calculations, information processing, and device control by various programs that are stored in the storage section 109 of the printing apparatus 102 and are loaded in the RAM 108. The RAM 108 is a kind of general volatile storage devices directly accessible from the CPU 107, and is used as a work area for the CPU 107 and also for temporary storage of data.

The storage section 109 plays a role of temporarily or permanently storing a print job received from the host computer 101, and is implemented by a hard disk drive in the present embodiment.

The reading section 110 is for reading a paper original by an optical system, and is e.g. a scanner. The scanner includes an original illuminating lamp and a scanning mirror, and optically scans an original placed on an original platen glass. A reflected light from the original is introduced to a lens by a scanning mirror and a reflective mirror, and an optical signal having passed through the lens is introduced to a solid image pickup device, not shown. The optical signal is converted to an electrical signal by the solid image pickup device and is recognized as an image signal. The solid image pickup device is, for example, a CCD (charge coupled device) or a CMOS (complementary metal oxide semiconductor) image sensor.

The print job processor 111 processes a print job, such as copying or printing of PDL data, to generate print image data, and transfers the generated print image data to the image forming section 112, described hereinafter. The print job processor 111 is realized by loading a program stored in the storage section 109 into the RAM 108, and executing the loaded program by the CPU 107. Note that PDL (page description language) refers to a language for describing commands for controlling a page printer, typified by PS (PostScript) and PCL (printer control language).

Upon receipt of a print job, the print job processor 111 performs image processing on the print job data according to the print attributes, and rasterizes the processed data, page by page, to generate print image data.

The image forming section 112 is a device for printing the raster data as the print image data sent from the print job processor 111, and is implemented by a printer engine in the preset embodiment.

The image forming section 112 forms an image on a printing sheet (also referred to as a sheet) based on the raster data generated in RIP (raster image processor) processing executed by the print job processor 111 to generate a printed sheet. Although in the present embodiment, toner is used for image formation by an electrophotographic method, any other suitable material other than toner, such as ink, may be used.

The console section 113 is a user interface for enabling the user to perform general operations on the printing apparatus 102, and is implemented by a touch panel LCD (liquid crystal display) in the present embodiment.

The sheet feeding section 114 stores printing sheets for use in copying machines or printers. The sheet feeding section 114 is called cassette or deck, and is generally provided in plurality. As described hereinafter, in the present embodiment, the sheet feeding section 114 comprises five sheet feeding cassettes, i.e. a first sheet feeding cassette 201 to a fifth sheet feeding cassette 205. Which of the plurality of sheet feeding cassettes is to feed printing sheets depends on the sheet attributes designated in the print job, and is determined by the print job processor 111. A printing sheet having been fed from the sheet feeding section 114 is subjected to image formation by the image forming section 112.

The sheet discharging section 115 discharges a printed sheet formed by the image forming section 112 out of the printing apparatus 102. In the present embodiment, the sheet discharging section 115 is implemented by a finisher. The finisher used in the present embodiment has three discharge trays, i.e. a first discharge tray 206 to a third discharge tray 208, and which of these is to be used is determined by the print job processor according to the attributes designated in the print job, and is designated and subjected to discharge control.

The network 103 is a global or local network, typified by the Internet or a LAN, and connects the printing apparatus 102 and the host computer 101 using e.g. TCP/IP.

Next, the print job processor 111 in the present embodiment will be further described. When it is determined that a print job includes printing of a plurality of copies, and designation of use of a type of sheets in which a plurality of sheets form one set, the print job processor 111 identifies any of the first to fifth sheet feeding cassettes 201 to 205 of the sheet feeding section 114, in which the sheets of this type are set, (in the case of an example in the present embodiment, the number of identified sheet feeding cassettes is assumed to be plural). Then, the print job processor 111 sequentially feeds sheets of this type from each of the plurality of identified sheet feeding cassettes of the sheet feeding section 114, for each copy.

After feeding of sheets from all of the identified sheet feeding cassettes of the sheet feeding section 114 has been finished once, if part of one set of sheets of this type remain as surplus sheets in each of the identified sheet feeding cassettes of the sheet feeding section 114, these surplus sheets are collectively discharged to one of the first to third discharge trays 206 to 207 of the sheet discharging section 115, which is different from another to which print products of the print job are discharged. Note that although in the following description of the present embodiment, a type of sheets that are handled in units of bundles (sets) each formed by a plurality of sheets is assumed to be tab sheets, any other type of sheets, similar in the above-mentioned feature, may be used. For example, a type of sheets having page numbers of e.g. 1 to 3 or 1 to 5 printed thereon may be used.

Figure 2:
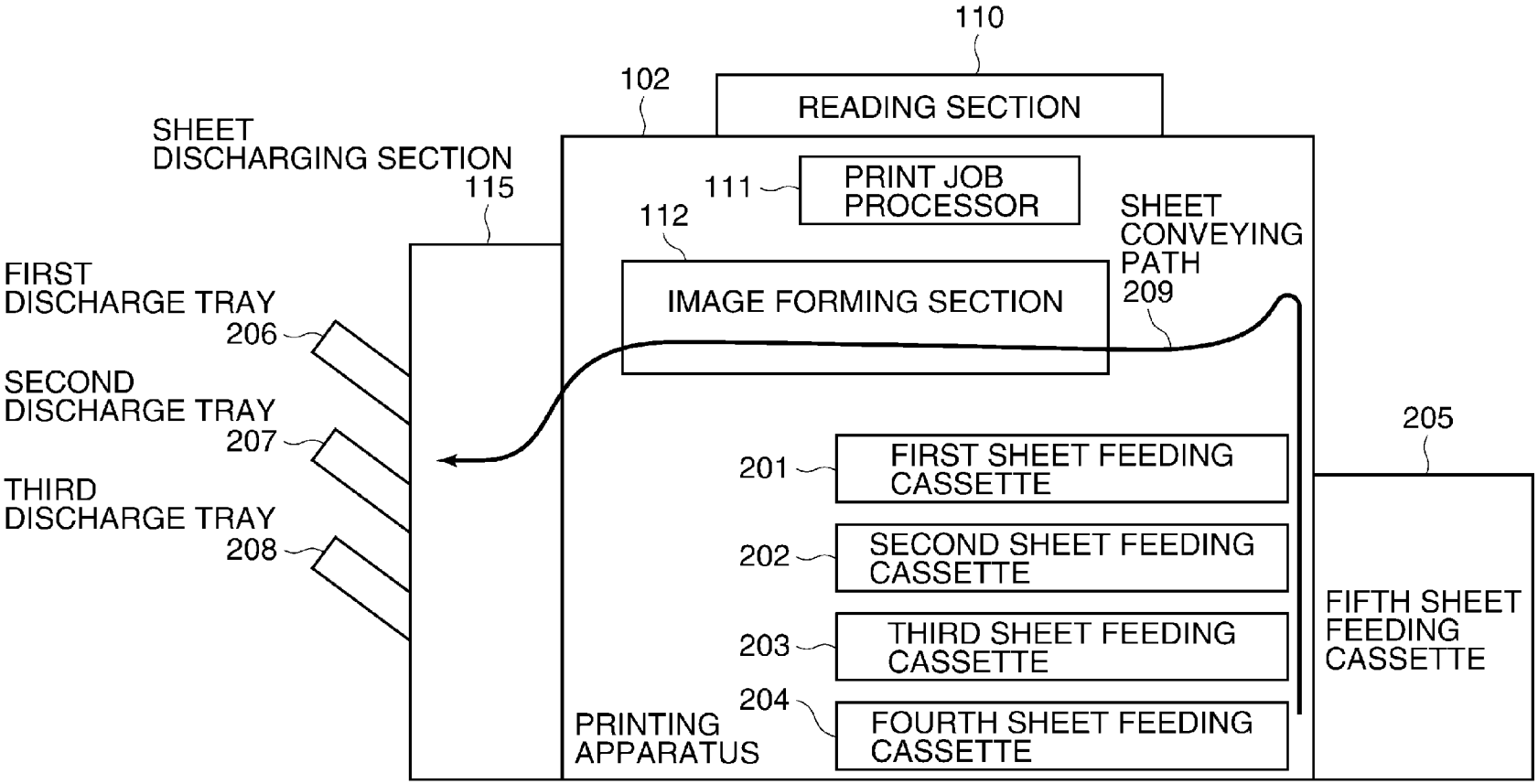
FIG. 2 is a view useful in explaining a sheet feeding section, a sheet discharging section, and a sheet conveying path of the printing apparatus appearing in FIG. 1.

FIG. 2 is a view useful in explaining the sheet feeding section 114, the sheet discharging section 115, and a sheet conveying path of the printing apparatus 102 appearing in FIG. 1.

In FIG. 2, the sheet feeding section 114 appearing in FIG. 1 comprises, as mentioned above, the first sheet feeding cassette 201, a second sheet feeding cassette 202, a third sheet feeding cassette 203, a fourth sheet feeding cassette 204, and the fifth sheet feeding cassette 205*a*.

Further, as mentioned before, the printing apparatus 102 includes the reading section 110, the print job processor 111, the image forming section 112, and the sheet discharging section 115. The sheet discharging section 115 is provided, as mentioned above, with the first discharge tray 206, a second discharge tray 207, and the third discharge tray 208.

The sheet conveying path, denoted by reference numeral 209, schematically represents a path along which, after the start of the print control performed by the print job processor 111, printing sheets are fed from any of the first to fifth sheet feeding cassettes 201 to 205 and are conveyed through the image forming section 112 to enter the sheet discharging section 115. In the present embodiment, the printed sheet formed in the image forming section 112 is discharged from a fixed discharge outlet included in the sheet discharging section 115, and hence it is necessary to vertically move a selected one of the first to third discharge trays 206 to 208 to a predetermined discharge position according to an attribute of the print job indicative of a discharge destination.

Figure 3:
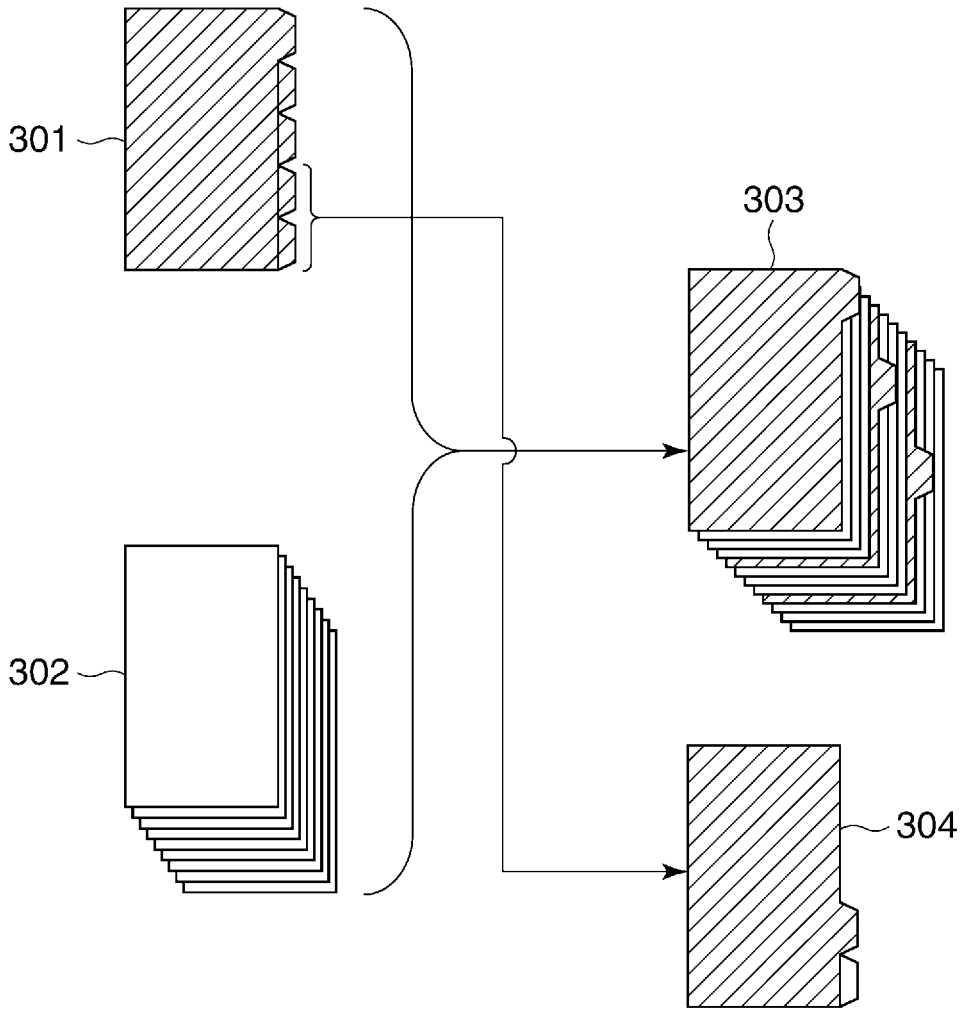
FIG. 3 is a view useful in explaining a method of discharging a print product and surplus tab sheets in a print job including insertion of tab sheets.

FIG. 3 is a view useful in explaining a method of discharging a print product and surplus tab sheets in a print job including insertion of tab sheets.

First, if printing sheets of the print job include tab sheets, at least a tab sheet set 301 and printing sheets 302 for body text are required to be stored in the first to fifth sheet feeding cassettes 201 to 205 of the sheet feeding section 114. Note that the term "sheets for body text" refers to a type of sheets designated by a print job for printing body text thereon, such as plain paper, thick paper, thin paper, colored paper, or gloss paper, for example, but in the present embodiment, the type of sheets is not particularly limited.

Next, according to the configuration of the print job, a required number of tab sheets are inserted between the printing sheets 302 for body text, and finally, a print product 303 of the print job is obtained. Although in the present embodiment, the tab sheet set 301 is formed by five tab sheets provided with respective five different tabs, and three of the five tab sheets are used in the print job, the description is given only by way of an example.

Only three tab sheets of the tab sheet set 301 are used in the print products 303 for the print job, as mentioned above, and hence two tab sheets of the tab sheet set 301 remain in a sheet feeding cassette that stored the tab sheet set 301.

These two tab sheets are unnecessary for a subsequent print job, and hence after completion of the current print job, they are discharged out of the printing apparatus 102 as surplus tab sheets 304. At this time, the surplus tab sheets 304 are discharged to one of the first to third discharge trays 206 to 208, which is different from a discharge tray to which the print product of the print job was discharged.

Figure 4B:
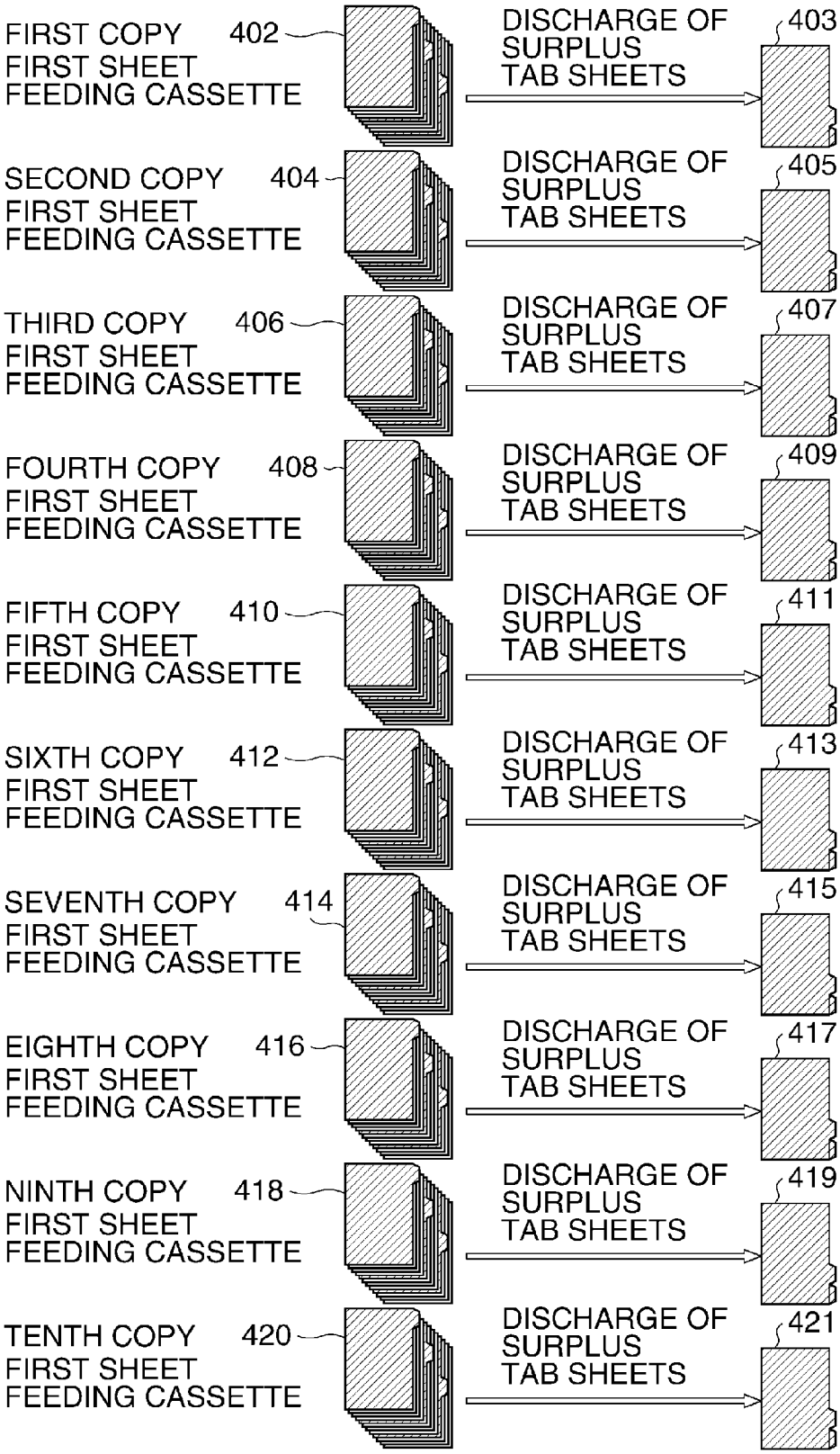

FIGS. 4A and 4B are views showing sheet information and a conventional sheet discharging method. FIG. 4A shows the sheet information, denoted by reference numeral 401, on the sheets stored in the sheet feeding section 114 of the printing apparatus 102. FIG. 4B shows a method of feeding tab sheets and a method of discharging surplus tab sheets, which have been conventionally employed.

First, according to the sheet information 401 on the sheets stored in the sheet feeding section 114 of the printing apparatus 102, tab sheets, as a type of sheets, are set in the first sheet feeding cassette 201, the second sheet feeding cassette 202, and the third sheet feeding cassette 203.

Further, plain paper is set in the fourth sheet feeding cassette 204, and thick paper is set in the fifth sheet feeding cassette 205, as a type of sheets. Note that although the sheet information includes other attributes, such as a sheet size and a basis weight, these information items are unnecessary for the description of an example of operations shown in FIG. 4B, and hence are omitted.

Next, the methods of feeding tab sheets and discharging surplus tab sheets will be described, taking a print job including designation of use of tab sheets as an example. Although in this example, it is assumed that the number of copies designated by the print job is 10, it may be any other number. The print job processor 111 inserts a required number of tab sheets between printing sheets for body text, as mentioned above, and outputs a first copy 402 as a print product of the print job. In doing this, it is assumed that the tab sheets are in the first to third sheet feeding cassettes 201 to 203, as mentioned above, and first, a required number of tab sheets are fed from the first sheet feeding cassette 201. Then, after the first copy 402 is output as the print product, the print job processor 111 causes surplus tab sheets 403 remaining in the first sheet feeding cassette 201 to be discharged to one of the first to third discharge trays 206 to 208 of the sheet discharging section 115, which is different from a discharge tray to which the first copy 402 was discharged as the print product.

Next, the print job processor 111 instructs printing of a second copy 404, similarly to the first copy 402, and causes tab sheets to be continuously fed from the first sheet feeding cassette 201. In general, when sheets of the same type, not alone tab sheets, are stored in a plurality of sheet feeding cassettes of the sheet feeding section 114, the printing apparatus 102 continues to feed sheets of the same type from the same sheet feeding cassette, and upon running out of the sheets in the sheet feeding cassette, the sheet feeding cassette is switched to another of the plurality of sheet feeding cassette storing the same type of sheets.

In other words, if the tab sheets are fed from the second sheet feeding cassette 202 to output the first copy 402, the print job processor 111 causes the tab sheets to be similarly fed from the second sheet feeding cassette 202 for the second copy 404.

When the second copy 404 is output as a print product, the print job processor 111 causes surplus tab sheets 405 remaining in the first sheet feeding cassette 201 to be discharged to the discharge tray different from the discharge tray to which the second copy 404 was discharged, similarly to the surplus tab sheets 403.

Next, the print job processor 111 causes a third copy 406 to be output as a print product similarly to the first copy 402 and the second copy 404, and causes the tab sheets to be continuously fed from the first sheet feeding cassette 201. Then, after causing the third copy 406 to be output as the print product, the print job processor 111 causes surplus tab sheets 407 remaining in the first sheet feeding cassette 201 to be discharged to the discharge tray different from the discharge tray to which the third copy 406 was discharged.

Next, similarly to the above, after the print job processor 111 causes a fourth copy 408 to be output as a print product, the print job processor 111 causes surplus tab sheets 409 remaining in the first sheet feeding cassette 201 to be discharged to the discharge tray different from the discharge tray to which the fourth copy 408 was discharged.

Next, similarly to the above, after causing a fifth copy 410 to be output as a print product, the print job processor 111 causes surplus tab sheets 411 remaining in the first sheet feeding cassette 201 to be discharged to the discharge tray different from the discharge tray to which the fifth copy 410 was discharged.

Next, similarly to the above, after causing a sixth copy 412 to be output as a print product, the print job processor 111 causes surplus tab sheets 413 remaining in the first sheet feeding cassette 201 to be discharged to the discharge tray different from the discharge tray to which the sixth copy 412 was discharged.

Next, similarly to the above, after causing a seventh copy 414 to be output as a print product, the print job processor 111 causes surplus tab sheets 415 remaining in the first sheet feeding cassette 201 to be discharged to the discharge tray different from the discharge tray to which the seventh copy 414 was discharged.

Next, similarly to the above, after causing an eighth copy 416 to be output as a print product, the print job processor 111 causes surplus tab sheets 417 remaining in the first sheet feeding cassette 201 to be discharged to the discharge tray different from the discharge tray to which the eighth copy 416 was discharged.

Next, similarly to the above, after causing a ninth copy 418 to be output as a print product, the print job processor 111 causes surplus tab sheets 419 remaining in the first sheet feeding cassette 201 to be discharged to the discharge tray different from the discharge tray to which the ninth copy 418 was discharged.

Next, similarly to the above, after causing a tenth copy 420 to be output as a print product, the print job processor 111 causes surplus tab sheets 421 remaining in the first sheet feeding cassette 201 to be discharged to the discharge tray different from the discharge tray to which the tenth copy 420 was discharged.

Now, as mentioned above, particularly in the electrophotographic printing apparatus, due to discharge of surplus tab sheets out of the printing apparatus, the temperature of a fixing device of the printing apparatus lowers, it requires time to adjust the temperature of the fixing device to resume printing.

Further, depending on the printing apparatus, the temperature of a fixing device optimum for sheets is different depending on a sheet type, and hence whenever the sheet type is changed, the temperature of the fixing device is adjusted, and it takes time to achieve the temperature adjustment. After discharging the surplus tab sheets out of the apparatus as well, it requires time to adjust the temperature of the fixing device to a temperature optimum for normal sheets. However, particularly when the surplus tab sheets are discharged out of the apparatus, the fixing device does not perform a fixing operation, and hence the temperature of the fixing device is lowered, which requires a longer time period to achieve temperature adjustment of the fixing device for resuming printing.

Although the above-mentioned temperature adjustment is executed whenever switching occurs between normal sheets and tab sheets in the print job, the temperature adjustment after discharge of surplus tab sheets out of the printing apparatus is executed whenever each copy is output.

In the case of FIG. 4B, since the number of copies is 10, it is necessary to perform the discharge of surplus tab sheets out of the printing apparatus ten times.

For example, assuming that it takes 90 seconds to perform the discharge of surplus tab sheets out of the printing apparatus and the temperature adjustment thereafter, it has to spend as long as 15 minutes in total for the discharge of surplus tab sheets out of the printing apparatus and the temperature adjustment thereafter, before obtaining all print products and completing the printing job. On the other hand, since the surplus tab sheets are discharged to a discharge tray different from one to which the print products of the print job are discharged, it takes time to switch between discharging destinations. More specifically, as in the case of the present embodiment, assuming that the sheet the sheet discharging section is implemented by a finisher having a fixed discharge outlet, and it takes time to vertically move a discharge tray to the position of the fixed discharge outlet, for switching between discharge trays for use.

This switching between discharge trays for use occurs whenever the discharge is switched between print products of a print job and surplus tab sheets. In the case of FIG. 4B, since the number of copies is 10, it is necessary to perform a switching operation requiring vertical movement of a discharge tray ten times. For example, assuming that it takes 20 seconds to switch between the discharge trays, it has to spend as long as a little over three minutes in total to switch between the discharge trays, before all print products are obtained.

In any case, it takes long time unnecessary for printing itself to discharge surplus tab sheets out of the printing apparatus, causing lowered productivity of the printing apparatus.

To eliminate this inconvenience, the present embodiment employs a method of feeding tab sheets and a method of discharging surplus tab sheets, which prevent lowering of productivity. Hereafter, a description is given of these methods.

FIG. 5 is a view useful in explaining the method of feeding tab sheets and the method of discharging surplus tab sheets in the present embodiment.

Note that sheet information used in an example of operations of the printing apparatus 102 in the description of these methods which is given with reference to FIG. 5 is the same as the sheet information shown in FIG. 4A, and hence description thereof is omitted.

Next, the method of feeding tab sheets and the method of discharging tab sheets in the present embodiment will be described, taking a print job including insertion of tab sheets as an example. Although in the present embodiment, the description will be given assuming that the number of copies designated by the print job is 10, it may be any other number.

The print job processor 111 of the printing apparatus 102 as the image forming apparatus according to the present embodiment inserts a required number of tab sheets between printing sheets for body text, and outputs a first copy 502 as a print product of the print job. In doing this, since the tab sheets are stored in the first to third sheet feeding cassettes 201 to 203, the print job processor 111 causes the tab sheets for the first copy 502 to be fed from one of the first to third sheet feeding cassettes 201 to 203, in the case of the present example, from the first sheet feeding cassette 201.

At this time, there remain sheet feeding cassettes containing tab sheets without surplus tab sheets, and hence even after the first copy 502 is output as a print product, the print job processor 111 does not cause surplus tab sheet 503 remaining in the first sheet feeding cassette 201 to be discharged out of the printing apparatus 102.

Next, similarly to the first copy 502, the print job processor 111 causes a second copy 504 to be output as a print product of the print job, and in doing this, in this example, the print job processor 111 causes tab sheets to be fed from the second sheet feeding cassette 202. That is, in a case where the tab sheets are stored in a plurality of sheet feeding cassettes, the printing apparatus 102 sequentially feeds tab sheets from a different sheet feeding cassette, for each tab sheet set. At this time, there remains a sheet feeding cassette containing tab sheets without surplus tab sheets. Therefore, even after the second copy 504 is output, the print job processor 111 does not cause surplus tab sheets 505 remaining in the second sheet feeding cassette 202 to be discharged out of the printing apparatus 102.

Next, similarly to the first copy 502 and the second copy 504, the print job processor 111 causes a third copy 506 to be output as a print product of the print job, and in doing this, the print job processor 111 causes tab sheets to be fed from the third sheet feeding cassette 203. That is, in a case where the tab sheets are stored in a plurality of sheet feeding cassettes, the printing apparatus 102 feeds tab sheets of each tab sheet set, from a different one of the sheet feeding cassettes, sequentially.

Then, after the third copy 506 has been output, the print job processor 111 causes the surplus tab sheets 503 and 505 remaining in the first and second sheet feeding cassettes 201 and 202, and surplus tab sheets 507 remaining in the third sheet feeding cassette 203 to be continuously discharged to one of the discharge trays 206 to 208 of the sheet discharging section 115, which is different from another of the discharge trays 206 to 208 to which the first copy 502 to the third copy 506 were discharged. That is, after the feeding of tab sheets from all of the sheet feeding cassettes 201 to 203 storing tab sheets has been finished once, the printing apparatus 102 collectively discharges surplus sheets remaining in all the sheet feeding cassettes 201 to 203 out of the printing apparatus.

Next, similarly to the above, although the print job processor 111 causes a fourth copy 508 to be output as a print product, at this time there remain sheet feeding cassettes each containing tab sheets without surplus tab sheets, and hence the print job processor 111 does not cause surplus tab sheets 509 remaining in the first sheet feeding cassette 201 to be discharged out of the printing apparatus 102.

Next, similarly to the above, although the print job processor 111 causes a fifth copy 510 to be output as a print product, at this time, there remains a sheet feeding cassette containing tab sheets without surplus tab sheets, and hence the print job processor 111 does not cause surplus tab sheets 511 remaining in the second sheet feeding cassette 202 to be discharged out of the printing apparatus 102.

Next, similarly to the above, the print job processor 111 causes a sixth copy 512 to be output as a print product. Then, the print job processor 111 causes the surplus tab sheets 509 and 511 remaining in the first and second sheet feeding cassettes 201 and 202 and surplus tab sheets 513 remaining in the third sheet feeding cassette 203 to be continuously discharged to the discharge tray different from the discharge tray to which the fourth copy 508 to the sixth copy 512 were discharged.

Next, similarly to the above, although the print job processor 111 causes a seventh copy 514 to be output as a print product, at this time, there remain sheet feeding cassettes containing tab sheets without surplus tab sheets, and hence the print job processor 111 does not cause surplus tab sheets 515 remaining in the first sheet feeding cassette 201 to be discharged out of the printing apparatus 102.

Next, similarly to the above, although the print job processor 111 causes an eighth copy 516 to be output as a print product, at this time, there remains a sheet feeding cassette containing tab sheets without surplus tab sheets, and hence the print job processor 111 does not cause surplus tab sheets 517 remaining in the second sheet feeding cassette 202 to be discharged out of the printing apparatus.

Next, similarly to the above, the print job processor 111 causes a ninth copy 518 to be output as a print product. Then, the print job processor 111 causes the surplus tab sheets 515 and 517 remaining in the first and second sheet feeding cassettes 201 and 202 and surplus tab sheets 519 remaining in the third sheet feeding cassette 203 to be continuously discharged to the discharge tray different from the discharge tray to which the fourth copy 515 to the sixth copy 518 were discharged.

Next, similarly to the above, a tenth copy 520 is obtained as a print product. Then, the required number of copies have been output as the print products of the print job, and hence the print job processor 111 causes surplus tab sheets 521 remaining in the first sheet feeding cassette 201 to be discharged to the discharge tray different from the discharge tray to which the tenth copy 520 was discharged.

By executing the above-described method of feeding tab sheets and method of discharging surplus tab sheets, it is possible to cut six operations of discharging surplus tab sheets, whereby the time required to perform the discharge of surplus tab sheets and the temperature adjustment can be reduced by a total of nine minutes, i.e. by 60% compared with the above-described conventional technique in which a total time of 15 minutes is spent therefor.

On the other hand, it is possible to cut six operations of switching discharges trays, the time required to switch the discharge trays can be reduced by a total of two minutes, i.e. by 60%, compared with the above-described conventional technique which a total time of a little over three minutes is spent therefor.

In both cases, the time spent for discharging surplus tab sheets, which is originally unnecessary for the purpose of obtaining print products of a print job, is largely reduced, whereby productivity of the printing apparatus 102 for obtaining print products is remarkably improved.

As described above, the printing apparatus 102 includes a plurality of (five, in the present embodiment) sheet feeding cassettes in each of which printing sheets are set. Out of these, two or more sheet feeding cassettes (first sheet feeding units; the first to third sheet feeding cassettes in the sheet information in FIG. 4A) have first sheets (e.g. tab sheets) set therein which are used in sets each formed by a plurality of first sheets. Further, at least one sheet feeding cassette (second sheet feeding unit; the fourth sheet feeding cassette in the sheet information in FIG. 4A) has second sheets (e.g. plain paper sheets) set therein which are different from the first sheets. This enables the printing apparatus 102 to generate print products in which at least part of first sheets and second sheets are mixed.

FIG. 6 is a flowchart of a print control process executed by the CPU 107 appearing in FIG. 1.

First, in the printing apparatus 102, the print job processor 111 receives a print job from the host computer 101, whereby processing in the printing system is started. Further, the print job processor 111 is configured to temporarily spool the print job received from the host computer 101 in the storage section 109.

In FIG. 6, the print job processor 111 analyzes the received print job, and determines whether or not the print job includes insertion of tab sheets (step S601). If it is determined in the step S601 that the print job includes does not include insertion of tab sheets (NO to the step S601), although not shown, normal printing is executed, followed by terminating the present process.

On the other hand, if it is determined in the step S601 that the print job includes insertion of tab sheets (YES to the step S601), the print job processor 111 determines whether or not the same type of tab sheets are stored in a plurality of sheet feeding cassettes of the sheet feeding section 114 of the printing apparatus 102 (step S602). If it is determined in the step S602 that the same type of tab sheets are not stored in a plurality of sheet feeding cassettes of the sheet feeding section 114 (NO to the step S602), although not shown, normal printing is executed, followed by terminating the present process.

On the other hand, if it is determined in the step S602 that the same type of tab sheets are stored in a plurality of sheet feeding cassettes of the sheet feeding section 114 (YES to the step S602), the print job processor 111 acquires information on the total number of the sheet feeding cassettes storing the tab sheets, and sets the acquired number as N (step S603).

Next, the print job processor 111 starts print processing for printing, including raster image processing (step S604). A total number of copies designated by the print job is set as X.

Next, the print job processor 111 sets, out of the total number X of copies required to be printed, the number of copies on which print processing has been completed, as M, and determines whether or not a value of M is equal to any of multiples of N, including N itself (step S605). That is, when the use of all of the plurality of sheet feeding cassettes containing the tab sheets has been made once, the print job processor 111 determines whether or not surplus tab sheets remain in all of the plurality of sheet feeding cassettes.

If it is determined in the step S605 that the value of M is equal to any multiple of N (YES to the step S605), the print job processor 111 collectively discharges the surplus tab sheets remaining in all of the sheet feeding cassettes for storing tab sheets (step 606), and the process proceeds to a step S611.

On the other hand, if it is determined in the step S605 that the value of M is not equal to any multiple of N (NO to the step S605), the print job processor 111 determines whether or not the value of M is equal to X (step S607). That is, the print job processor 111 determines whether or not print processing has been completed for all of the copies required to be printed by the print job.

If it is determined in the step S607 that the value of M is equal to X (YES to the step S607), the print job processor 111 performs the following processing: The print job processor 111 collectively discharges the surplus tab sheets out of the printing apparatus, which remain in the used sheet feeding cassettes of all the sheet feeding cassettes containing the tab sheets (step S608), followed by terminating the present process.

On the other hand, if it is determined in the step S607 that the value of M is not equal to X (NO to the step S607), the print job processor 111 changes the sheet feeding cassette for supplying tab sheets to a sheet feeding cassette from which next tab sheets to be used are fed (step S609). That is, at this time, there remains a sheet feeding cassette storing tab sheets without surplus tab sheet, and hence the surplus tab sheets remaining in the used sheet feeding cassettes are not discharged, but the sheet feeding cassette containing tab sheets without surplus tab sheets is used for the next copy.

Next, the print job processor 111 continues printing of the next copy (step S610), and returns to the step S605.

In the step S611, it is determined whether or not the value of M is equal to X, i.e. the printing of all copies required to be printed by the print job has been completed. If it is determined in the step S611 that the value of M is equal to X, i.e. that the printing of all copies required to be printed by the print job has been completed (YES to the step S611), the present process is terminated.

On the other hand, it is determined in the step S611 that the value of M is not equal to X (NO to the step S611), the print job processor 111 changes the sheet feeding cassette for supplying tab sheets to a sheet feeding cassette from which next tab sheets to be used are fed (step S612), and the process proceeds to the step S610. That is, at this time, all of the sheet feeding cassettes storing tab sheets contain no surplus tab sheets, and hence the sheet feeding cassette containing tab sheets, which was first used for the print job, is set to be used for the next copy.

Then, similarly to after the execution of the step S609, the print job processor 111 continues to execute processing for printing the next copy (step S610), and then the process returns to the step S605.

According to the present embodiment, it is possible to remarkably reduce the time required to discharge surplus tab sheets and perform temperature adjustment thereafter, of the time required to obtain print products of a print job, to thereby largely improve productivity of the printing apparatus for obtaining the print products.

In the printing apparatus 102 according to the present embodiment as described above, the order of feeding of at least part of each set of first sheets is determined in advance for each two or more first sheet feeding units. Then, first sheets are fed in the predetermined order, and second sheets are fed from the second sheet feeding cassette to thereby produce a print product. This procedure is repeated, whereby a plurality of print products are produced. In the present invention, an operation of a product production unit configured to generates a print product corresponds to the processing of the step S603 et seq. except the steps S606 and S608.

Further, in the printing apparatus 102 as the image forming apparatus according to the present embodiment, after a print product is obtained by performing sheet feeding from the first sheet feeding cassette which is the last in the predetermined order, the surplus first sheets remaining unused for producing the print products are discharged from each of the first sheet feeding cassettes. In the present invention, an operation of a sheet discharge unit corresponds to the processing of the steps S606 and S608.

As a result, it is possible to reduce the frequency of switching between production of print products and discharge of surplus tab sheets out of the printing apparatus, and hence it is possible to reduce time required for temperature adjustment when print products are produced in each of which different sheets are mixed.

Note that the predetermined order is the order of the first sheet feeding cassette 201, the second sheet feeding cassette 202, and the third sheet feeding cassette 203 in the present embodiment. Therefore, the sheet feeding is repeated such that first sheets are fed from the first sheet feeding cassette, the second sheet feeding cassette, and the third sheet feeding cassette in the mentioned order, and when first sheets have been fed from the third sheet feeding cassette which is the last in the order, sheet feeding returns to the first in the order to thereby feed first sheets from the first sheet feeding cassette again.

Next, a description will be given of a second embodiment of the present invention. A printing apparatus as an image forming apparatus according to the second embodiment has the same configuration as that of the printing apparatus according to the first embodiment, shown in FIGS. 1 and 2, and hence description thereof is omitted.

Surplus tab sheets are unnecessary for the purpose of obtaining print products of a print job, so that it is desirable that no time is required for discharging the surplus tab sheets. However, in general, the tab sheets are a type of sheets which are handled in units of sets each formed by a plurality of sheets, and all of tab sheets in one set are not necessarily used for a print job, so that a case occurs where unused i.e. surplus tab sheets are required to be discharged out of the printing apparatus during print processing.

However, for example, assuming that it is necessary to produce ten print products including tab sheets, and tab sheets are set in three sheet feeding cassettes, a third discharge of surplus tab sheets out of the printing apparatus is not necessarily performed for all of the three sheet feeding cassettes because the number of print products remaining to be produced is one.

In the above-mentioned case, it is only required to perform the discharge of surplus tab sheets, from sheet feeding cassettes corresponding in number to a remaining number of print products required to be printed, in the present example, from one sheet feeding cassette. As mentioned above, it is possible to cut the number of operations of discharge of surplus tab sheets to be performed from two sheet feeding cassettes, thereby reducing time required for discharging from the two sheet feeding cassettes to zero, while achieving the purpose of obtaining ten print products.

Of course, although the surplus tab sheets are discharged from the two remaining sheet feeding cassettes after completion of all print products, it is possible to ignore the time required to discharge the surplus tab sheets, from the viewpoint of the purpose of obtaining the print products of the print job.

In view of this, according to the second embodiment, when the number of remaining copies required to be produced is less than the total number of the plurality of sheet feeding cassettes containing the tab sheets, surplus tab sheets are discharged not from all of the used sheet feeding cassettes but from only sheet feeding cassettes corresponding in number to the number of remaining copies required to be produced.

FIG. 7 is a view useful in explaining a method of feeding tab sheets and a method of discharging surplus tab sheets in the present embodiment.

Note that the sheet information used in FIG. 7 is the sheet information shown in FIG. 4A.

First, according to the sheet information 401 stored in the sheet feeding section 114 of the printing apparatus 102, tab sheets are set in the first sheet feeding cassette, the second sheet feeding cassette, and the third sheet feeding cassette, as a type of sheets.

Further, plain paper and thick paper are set in the fourth sheet feeding cassette and the fifth sheet feeding cassette, respectively, as respective types of sheets. Note that although the sheet information includes other attributes, such as a sheet size and a basis weight, these information items are unnecessary for the description of the present embodiment, and hence are omitted.

Next, the method of feeding tab sheets and the method of discharging tab sheets in the present embodiment will be described, taking a print job including insertion of tab sheets as an example. Although in the present embodiment, the description will be given assuming that the number of copies designated by the print job is 10, it may be any other number.

The print job processor 111 of the printing apparatus 102 as the image forming apparatus according to the present embodiment inserts a required number of tab sheets between printing sheets for body text, and outputs a first copy 702 as a print product of the print job. In doing this, since the tab sheets are stored in the first to third sheet feeding cassettes 201 to 203, the print job processor 111 causes the tab sheets for the first copy 702 to be fed from one of the first to third sheet feeding cassettes 201 to 203, in the case of the present example, from the first sheet feeding cassette 201. At this time, there remain sheet feeding cassettes containing tab sheets without surplus tab sheets, and hence even after the first copy 702 is output as a print product, the print job processor 111 does not cause surplus tab sheet 703 remaining in the first sheet feeding cassette 201 to be discharged out of the printing apparatus 102.

Next, similarly to the first copy 702, the print job processor 111 causes a second copy 704 to be output as a print product of the print job, and in doing this, the print job processor 111 causes tab sheets to be fed from the second sheet feeding cassette 202. That is, in a case where the tab sheets are stored in a plurality of sheet feeding cassettes, the printing apparatus 102 sequentially feeds tab sheets from a different sheet feeding cassette, for each tab sheet set.

At this time, there remains a sheet feeding cassette containing tab sheets without surplus tab sheets. Therefore, even after the second copy 504 is output, the print job processor 111 does not cause surplus tab sheets 505 remaining in the second sheet feeding cassette 202 to be discharged out of the printing apparatus 102.

Next, similarly to the first copy 702 and the second copy 704, the print job processor 111 causes a third copy 706 to be output as a print product of the print job, and in doing this, the print job processor 111 causes tab sheets to be fed from the third sheet feeding cassette 203. That is, in a case where the tab sheets are stored in a plurality of sheet feeding cassettes, the printing apparatus 102 feeds tab sheets of each tab sheet set, from a different one of the sheet feeding cassettes, sequentially.

Then, after the third copy 706 has been output, the print job processor 111 causes the surplus tab sheets 703 and 705 remaining in the first and second sheet feeding cassettes 201 and 202, and surplus tab sheets 707 remaining in the third sheet feeding cassette 203 to be continuously discharged to one of the discharge trays 206 to 208 of the sheet discharging section 115, which is different from another of the discharge trays 206 to 208 to which the first copy 702 to the third copy 706 were discharged. That is, after the feeding of tab sheets from all of the sheet feeding cassettes 201 to 203 storing tab sheets has been finished once, the printing apparatus 102 collectively discharges surplus sheets remaining in all the sheet feeding cassettes 201 to 203 out of the printing apparatus.

Next, similarly to the above, although the print job processor 111 causes a fourth copy 708 to be output as a print product, at this time there remain sheet feeding cassettes each containing tab sheets without surplus tab sheets, and hence the print job processor 111 does not cause surplus tab sheets 709 remaining in the first sheet feeding cassette 201 to be discharged out of the printing apparatus 102.

Next, similarly to the above, although the print job processor 111 causes a fifth copy 710 to be output as a print product, at this time, there remains a sheet feeding cassette containing tab sheets without surplus tab sheets, and hence the print job processor 111 does not cause surplus tab sheets 711 remaining in the second sheet feeding cassette 202 to be discharged out of the printing apparatus 102.

Next, similarly to the above, the print job processor 111 causes a sixth copy 712 to be output as a print product. Then, the print job processor 111 causes the surplus tab sheets 709 and 711 remaining in the first and second sheet feeding cassettes 201 and 202 and surplus tab sheets 713 remaining in the third sheet feeding cassette 203 to be continuously discharged to the discharge tray different from the discharge tray to which the fourth copy 708 to the sixth copy 712 were discharged.

Next, similarly to the above, although the print job processor 111 causes a seventh copy 714 to be output as a print product, at this time, there remain sheet feeding cassettes containing tab sheets without surplus tab sheets, and hence the print job processor 111 does not cause surplus tab sheets 715 remaining in the first sheet feeding cassette 201 to be discharged out of the printing apparatus 102.

Next, similarly to the above, although the print job processor 111 causes an eighth copy 716 to be output as a print product, at this time, there remains a sheet feeding cassette containing tab sheets without surplus tab sheets, and hence the print job processor 111 does not cause surplus tab sheets 719 remaining in the second sheet feeding cassette 202 to be discharged out of the printing apparatus.

Next, similarly to the above, the print job processor 111 causes a ninth copy 718 to be output as a print product. At this time, the number of remaining copies required to be printed of all the copies of the print job is one, and hence the print job processor 111 causes the surplus tab sheets 715 remaining in the first sheet feeding cassette 201 to be discharged to the discharge tray different from the discharge tray to which the ninth copy 718 was discharged.

Next, similarly to the above, the print job processor 111 causes a tenth copy 520 to be output as a print product. Through the control described above, all the required number of copies have been output as the print products of the print job. Thereafter, the print job processor 111 causes surplus tab sheets 717 remaining in the first sheet feeding cassette 201, the surplus tab sheets 719 remaining in the second sheet feeding cassette 202, and surplus tab sheets 721 remaining the third sheet feeding cassette 203 to be collectively discharged to the discharge tray different from the discharge tray to which the tenth copy 720 was discharged.

By executing the above-described method of feeding tab sheets and method of discharging surplus tab sheets, it is possible to cut six operations of discharging surplus tab sheets, whereby the time required to perform the discharge of surplus tab sheets and the temperature adjustment can be reduced by a total of nine minutes, i.e. by 60% compared with the above-described conventional technique in which a total time of 15 minutes is spent therefor.

On the other hand, it is possible to cut six operations of switching discharges trays, the time required to switch the discharge trays can be reduced by a total of two minutes, i.e. by 60%, compared with the above-described conventional technique which a total time of a little over three minutes is spent therefor.

In both cases, the time spent for discharging surplus tab sheets, which is originally unnecessary for the purpose of obtaining print products of a print job, is largely reduced, whereby productivity of the printing apparatus 102 for obtaining print products is remarkably improved.

In addition, it is possible to cut the number of operations of discharge of surplus tab sheets to be performed from two sheet feeding cassettes, thereby reducing time required for discharging from the two sheet feeding cassettes to zero, while achieving the purpose of obtaining ten print products.

FIG. 8 is a flowchart of a print control process executed by the CPU 107 appearing in FIG. 1.

First, in the printing apparatus 102, the print job processor 111 receives a print job from the host computer 101, whereby processing in the printing system is started. Further, the print job processor 111 is configured to temporarily spool the print job received from the host computer 101 in the storage section 109.

In FIG. 8, the print job processor 111 analyzes the received print job, and determines whether or not the print job includes insertion of tab sheets (step S801). If it is determined in the step S801 that the print job includes does not include insertion of tab sheets (NO to the step S801), although not shown, normal printing is executed, followed by terminating the present process.

On the other hand, if it is determined in the step S801 that the print job includes insertion of tab sheets (YES to the step S801), the print job processor 111 determines whether or not the same type of tab sheets are set in a plurality of sheet feeding cassettes of the sheet feeding section 114 of the printing apparatus 102 (step S802). If it is determined in the step S802 that the same type of tab sheets are not set in a plurality of sheet feeding cassettes of the sheet feeding section 114 (NO to the step S802), although not shown, normal printing is executed, followed by terminating the present process.

On the other hand, if it is determined in the step S802 that the same type of tab sheets are stored in a plurality of sheet feeding cassettes of the sheet feeding section 114 (YES to the step S802), the print job processor 111 acquires information on the total number of the sheet feeding cassettes storing the tab sheets, and sets the acquired number as N (step S803).

Next, the print job processor 111 starts print processing for printing, including raster image processing (step S804). A total number of copies designated by the print job is set as X.

Next, the print job processor 111 sets, out of the total number X of copies required to be printed, the number of copies on which print processing has been completed, as M, and determines whether or not a value of M is equal to any of multiples of N, including N itself (step S805). That is, when the use of all of the plurality of sheet feeding cassettes containing the tab sheets has been made once, the print job processor 111 determines whether or not surplus tab sheets remain in all of the plurality of sheet feeding cassettes.

If it is determined in the step S805 that the value of M is equal to any multiple of N (YES to the step S805), the print job processor 111 determines whether or not a difference between X and the value of M is smaller than N (step S806). That is, the print job processor 111 determines whether or not unprinted copies required to be printed by the print job is less than the total number of the sheet feeding cassettes containing tab sheets.

If it is determined in the step S806 that the difference between X and the value of M is not smaller than N (NO to the step S806), the following processing is executed: The print job processor 111 collectively discharges the surplus tab sheets out of the printing apparatus, which remain in all the sheet feeding cassettes containing the tab sheets (step S809), and then proceeds to a step S814.

If it is determined in the step S806 that the difference between X and the value of M is smaller than N (YES to the step S806), the following processing is executed: The surplus tab sheets remaining in the sheet feeding cassettes containing tab sheets, from which tab sheets are to be fed until completion of the present print job, i.e. which correspond in number to the number of copies to be printed, i.e. X−M, are collectively discharged out of the printing apparatus (step S808), and the process proceeds to a step S813.

On the other hand, if it is determined in the step S805 that the value of M is not equal to any multiple of N (NO to the step S805), the print job processor 111 determines whether or not the value of M is equal to X (step S807). That is, the print job processor 111 determines whether or not print processing has been completed for all of the copies required to be printed by the print job.

If it is determined in the step S807 that the value of M is equal to X (YES to the step S807), the print job processor 111 performs the following processing: The print job processor 111 collectively discharges the surplus tab sheets out of the printing apparatus, which remain in the used sheet feeding cassettes of all the sheet feeding cassettes containing the tab sheets (step S608), followed by terminating the present process.

On the other hand, if it is determined in the step S807 that the value of M is not equal to X (NO to the step S807), the print job processor 111 changes the sheet feeding cassette for supplying tab sheets to a sheet feeding cassette from which next tab sheets to be used are fed (step S609). That is, at this time, there remains a sheet feeding cassette storing tab sheets without surplus tab sheet, and hence the surplus tab sheets remaining in the used sheet feeding cassettes are not discharged, but the sheet feeding cassette containing tab sheets without surplus tab sheets is used for the next copy.

Next, the print job processor 111 continues printing of the next copy (step S812), and returns to the step S805.

In the step S813, it is determined whether or not the value of M is equal to X, i.e. whether or not the printing of all copies required to be printed by the print job has been completed. If it is determined in the step S813 that the value of M is equal to X, i.e. the printing of all copies required to be printed by the print job has been completed (YES to the step S813), the present process is terminated.

On the other hand, it is determined in the step S813 that the value of M is not equal to X (NO to the step S613), the print job processor 111 changes the sheet feeding cassette for supplying tab sheets to a sheet feeding cassette from which next tab sheets to be used are fed (step S814), and the process proceeds to the step S812. That is, at this time, all of the sheet feeding cassettes storing tab sheets contain no surplus tab sheets, and hence the sheet feeding cassette containing tab sheets, which was first used for the print job, is set to be used for the next copy.

Then, similarly to after the execution of the step S811, the print job processor 111 continues to execute processing for printing the next copy (step S812), and then the process returns to the step S805.

In the printing apparatus 102 as the image forming apparatus according to the present embodiment, when a print product is obtained by performing sheet feeding from the first sheet feeding cassette which is the last in the predetermined order, if the number of remaining print products to be produced is less than the number of the first sheet feeding units (three in FIG. 7), the following processing is executed: The surplus first sheets which have been not used for the print products are discharged from first sheet feeding units corresponding in number to the number of the remaining print products to be produced, starting from a first one in the predetermined order to one corresponding in the predetermined order to the number of the remaining print products.

According to the present embodiment, it is possible to minimize the time required to perform surplus tab sheet discharge and temperature adjustment thereafter, of the time required to obtain print products of a print job, to thereby largely improve productivity of the printing apparatus for obtaining the print products. In addition, by reducing the number of operations of surplus tab sheet discharge per se as much as possible, it is possible to further improve the productivity for obtaining print products.

Further, according to the present embodiment, it is possible to remarkably reduce the time required to execute surplus tab sheet discharge per se. Further, by reducing the number of operations for discharging sheets, it is possible to largely reduce time required to switch between discharge trays or between discharge outlets, which becomes necessary for discharging surplus tab sheets to a discharge destination different from a discharge destination to which print products of a print job are discharged.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-164432, filed Jul. 27, 2011, which is hereby incorporated by reference herein in its entirety.

What is claimed is:

1. An image forming apparatus comprising:

a first sheet storage unit configured to store a plurality of sets of first sheets, each set including a plurality of the first sheets;

a second sheet storage unit configured to store a plurality of sets of the first sheets, each set including a plurality of the first sheets;

another sheet storage unit configured to store second sheets;

an inserting unit configured to insert at least a part of the first sheets of a set fed from the first sheet storage unit into the second sheets fed from the another sheet storage unit to produce first printed sheets, and following the first printed sheets, insert at least a part of the first sheets of a set fed from the second sheet storage unit into the second sheets fed from the another sheet storage unit to produce second printed sheets; and a discharge control unit configured to control to discharge surplus first sheets among the sets in the first sheet storage unit and surplus first sheets among the sets in the second sheet storage unit after the second printed sheets have been produced.

2. The image forming apparatus according to claim 1, further comprising an image forming unit configured to form images on the first sheets and the second sheets.

3. The image forming apparatus according to claim 1, wherein the first sheets are tab sheets.

4. The image forming apparatus according to claim 1, wherein the discharge control unit controls to discharge the surplus first sheets in the first sheet storage unit and the surplus first sheets in the second sheet storage unit to a sheet discharging destination which is different from a sheet discharging destination of the first printed sheets and the second printed sheets.

5. A method of controlling an image forming apparatus the method comprising:

storing, by a first sheet storage unit, a plurality of sets of first sheets, each set including a plurality of the first sheets;

storing, by a second sheet storage unit, a plurality of sets of the first sheets, each set including a plurality of the first sheets;

storing, by another sheet storage unit, second sheets;

inserting at least a part of the first sheets of a set fed from first sheet storage unit into the second sheets fed from another sheet storage unit to produce first printed sheets, and following the first printed sheets, inserting at least a part of the first sheets of a set fed from the second sheet storage unit into the second sheets fed from the another sheet storage unit to produce second printed sheets; and discharging surplus first sheets among the sets in the first sheet storage unit and surplus first sheets among the sets in the second sheet storage unit after the second printed sheets have been produced.

6. A non-transitory computer-readable storage medium storing a computer-executable program for causing a computer to execute a method of controlling an image forming apparatus, the method comprising:

storing, by a first sheet storage unit, a plurality of sets of first sheets, each set including a plurality of the first sheets;

storing, by a second sheet storage unit, a plurality of sets of the first sheets, each set including a plurality of the first sheets;

storing, by another sheet storage unit, second sheets;

inserting at least a part of the first sheets of a set fed from the first sheet storage unit into the second sheets fed from the another sheet storage unit to produce first printed sheets, and following the first printed sheets, inserting at least a part of the first sheets of a set fed from the second sheet storage unit into the second sheets fed from the another sheet storage unit to produce second printed sheets; and discharging surplus first sheets among the sets in the first sheet storage unit and surplus first sheets among the sets in the second sheet storage unit after the second printed sheets have been produced.

* * * * *